United States Patent [19]

Sands et al.

[11] Patent Number: 4,536,834

[45] Date of Patent: Aug. 20, 1985

[54] R LAMP HAVING AN IMPROVED NECK SECTION FOR INCREASING THE USEFUL LIGHT OUTPUT

[75] Inventors: Robert W. Sands, Hudson; Daniel M. Bloom, Euclid, both of Ohio

[73] Assignee: General Electric Company, Schenectady, N.Y.

[21] Appl. No.: 612,778

[22] Filed: May 22, 1984

[51] Int. Cl.[3] ..... F21V 7/09

[52] U.S. Cl. ..... 362/303; 362/297; 362/346; 362/347; 313/113

[58] Field of Search ..... 362/297, 303, 310, 311, 362/346, 347; 313/113, 114, 315, 318, 317, 479, 578–580

[56] References Cited

U.S. PATENT DOCUMENTS

| | | | |
|---|---|---|---|
| 2,671,183 | 3/1954 | St. Louis et al. | 313/317 X |
| 3,250,939 | 5/1966 | Dayton et al. | 313/317 X |
| 3,279,941 | 10/1966 | Foster et al. | 313/317 X |
| 3,384,781 | 5/1968 | Holle | 313/317 X |
| 4,001,621 | 1/1977 | Pace et al. | 313/113 |
| 4,041,344 | 8/1977 | La Guisa | 313/113 |
| 4,050,602 | 9/1977 | Tom et al. | 313/482 X |

*Primary Examiner*—Peter A. Nelson

*Attorney, Agent, or Firm*—John P. McMahon; Philip L. Schlamp; Fred Jacob

[57] ABSTRACT

A reflector (R) having an improved neck section that increases the useful light output of the lamp is disclosed. The reflector lamp comprises a concave reflector having a primary reflective surface with a parabolic shape, one or more intermediate reflective surfaces with a parabolic shape substantially confocal with the primary reflective surface, and an improved neck section comprising a reducing section, a first substantially straight cylindrical section, an expanding section and a second substantially straight cylindrical section.

13 Claims, 2 Drawing Figures

R LAMP HAVING AN IMPROVED NECK SECTION FOR INCREASING THE USEFUL LIGHT OUTPUT

BACKGROUND OF THE INVENTION

This invention is in the field of reflector lamps, such as those which include the commonly known reflector (R) lamp used for floodlighting and as spotlights.

Reflector (R) lamps are disclosed in U.S. patent application Ser. No. 589,903, filed Mar. 14, 1984, assigned to the assignee as the present invention and herein incorporated by reference. U.S. patent application Ser. No. 589,903 discloses R lamps having multiple and aimed parabolic reflective sections which improve the beam pattern of the R lamp.

Of the total lumens or light rays developed by the light source of the prior art reflector lamps such as that of U.S. patent application Ser. No. 589,903, an undesirable amount of light rays are disadvantageously reflected by the neck section of the reflector lamp in such a manner as to end up outside the desired or main beam pattern and, therefore, these rays are considered unusable.

A primary contributor to the disadvantageous reflection of light rays is the dimensions of the neck section. The diameter dimension is relatively large, being typically 37 mm. Although this relatively large neck diameter is disadvantageous with regard to light ray reflection, it is beneficial in providing for ease of insertion of the filament mount assembly and of a desired geometry for mating with the electrical base and also adhering to the base cement during the assembly of the reflector lamp. While the larger neck diameter of the reflector has certain structural benefits, it still remains optically disadvantageous.

It is desired that a reflector lamp be provided which reduces the undesirable amount of lumens disadvantageously reflected by the neck section of the reflector so as to improve the overall optical efficiency of the lamp itself while still providing the structural benefits advantageous to the assembly of the reflector lamp.

Accordingly, an object of the present invention is to provide a more efficient reflector lamp with an optically enhanced neck portion so as to more advantageously direct the light rays into the useful beam pattern of the reflector lamp and also allow ease of assembly of the lamp itself.

SUMMARY OF INVENTION

In accordance with the present invention the reflector lamp having an improved neck section which increases the useful light output of the reflector lamp is provided. The reflector lamp comprises a concave reflector having a primary reflective section with a parabolic shape and a focal point, and one or more intermediate reflective sections each having a parabolic shape substantially confocal with the primary reflective section. The one or more intermediate reflective sections are interconnected by transitional sections. The reflector lamp further comprises a neck section having a reducing section, a first substantially straight cylindrical section, an expanding section, and a second substantially straight cylindrical section for mating with the electrically conductive base of the reflector lamp. The neck section is effective in advantageously reflecting light rays impinging on its surface back into the useful beam pattern.

A more complete understanding of the present invention is obtained by considering the following description in conjunction with accompanying drawing.

DESCRIPTION OF THE PREFERRED EMBODIMENTS

Figure 1:
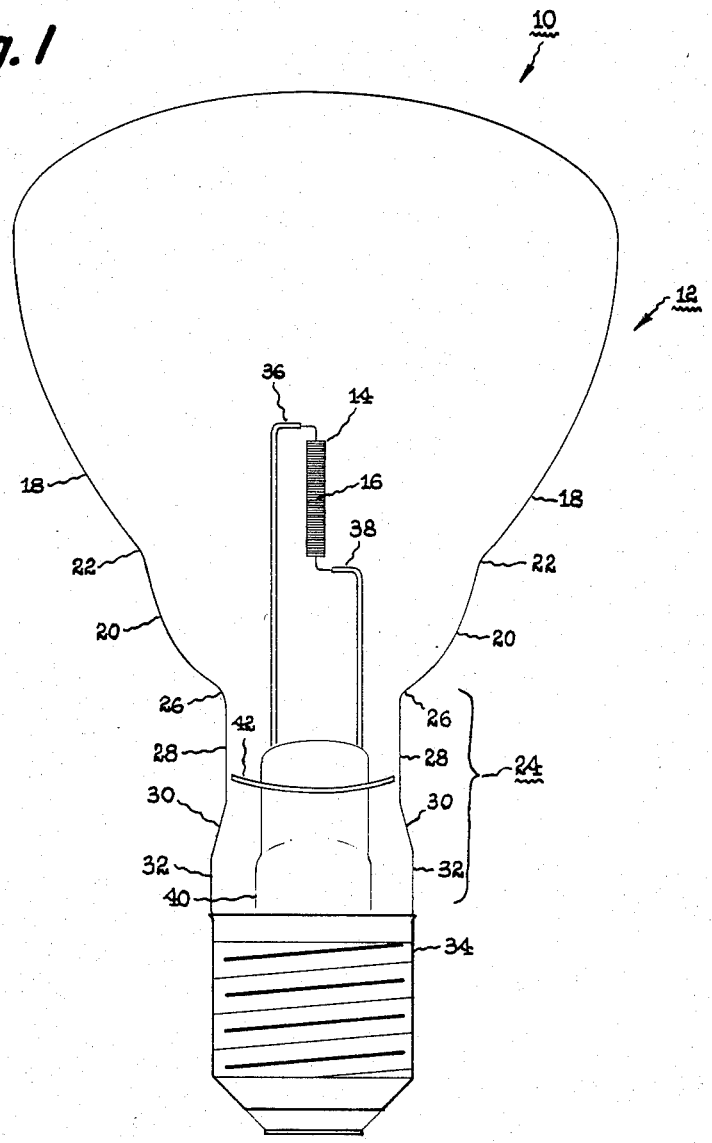
FIG. 1 shows a reflector lamp in accordance with the present invention.

FIG. 1 shows an improved reflector (R) lamp 10 in accordance with the present invention. The lamp 10 comprises a concave reflector 12 and a light source 14 having its geometric center 16 located approximately at the focal point of the concave reflector 12. The concave reflector comprises a reflective section 18 having a parabolic shape and a focal point, and an intermediate reflective section 20 having a parabolic shape substantially confocal with the primary reflective section 18 and joined to the primary reflective section by a transitional section 22 preferably having a radius of curvature in the range of about 1.0 mm to about 3.0 mm.

The concave reflector 12 further comprises a neck section 24 which is of primary interest to the present invention having a reducing section 26, a first substantially straight cylindrical section 28, an expanding section 30, and a second substantially straight cylindrical section 32 which is sealed to an electrically conductive base 34. The cylindrical section 32 and the expanding section 30 are uncoated, clear, translucent sections, whereas, cylindrical sections 28, reducing section 26, intermediate section 20, transitional section 22 and primary section 18 are all coated with a reflective material such as silver or aluminum.

The light source 14 of lamp 10 may be preferably axially aligned in a vertical manner parallel to the lamp axis or it may be aligned in a horizontal manner perpendicular to lamp axis. The light source 14 is neither infinite nor infinitesimal in size and is approximately centered at the focal point of the concave reflector 12 as generally either perpendicular or parallel to the axis of the lamp 10.

The light source 14 can be a filament preferably made of tungsten and mounted between a pair of inner leads 36 and 38 of suitable material such as copper plated with nickel. Alternate light sources can be employed in place of the tungsten filament such as the halogen regenerative cycle lamp or an arc discharge lamp. These alternate light sources act as a finite light source.

The inner leads 36 and 38 extend through a glass stem 40 and are electrically connected to appropriate portions (not shown) of the electrically conductive base 34. A light reflective heat shield 42 having a top reflective surface that is preferably parabolic shaped is positioned under the finite light source 14 and mounted onto the glass stem 40.

As discussed in the "Background" section above, it is desired that reflector lamps such as reflector lamp 10 direct as much as possible of the light emitted by the light source into a desired beam pattern. Of the total lumens of the light rays created by the light source of the prior art reflector lamps, an undesirable amount of light emitted by the light source is wasted by being undesirably reflected by the prior art neck section of the reflector lamp. Primary contributors are the reflective portions of the neck section undesirably reflecting the light rays out of the clear sections of the neck section and also undesirably into the electrically conductive base sections, both types of reflections ending up outside of the desired beam pattern, and are therefore considered wasted.

With regard to the characteristics of the prior art neck sections themselves, we have determined that if the diameter of the neck section could be reduced the optical characteristic of the neck section could be improved. While it was recognized that reducing the diameter of the neck section improved its optical characteristic, such reduction needs to be accomplished in such manner as to preserve the present benefits of the relatively large neck diameter with regard to reflector lamp assembly.

As discussed in "Background" section, the relatively large neck diameter is beneficial for ease of insertion of the filament mount assembly, and has a desired geometry for mating with the electrical base and adhering to the base cement all during the assembly of the reflector lamp. The present invention perserves these benefits by (1) having the substantially straight cylindrical section 28 which has a dimension allowing for ease of insertion of the filament assembly during lamp manufacture, (2) having an enlarging section 30 which is mated with the second cylindrical section, and (3) having the second cylindrical section with a desired geometry for mating with the electrical base 34 and adhering to the base cement during lamp manufacture.

In general, the present invention substantially reduces the reflections of the light rays associated with the neck section which are typically experienced by the prior devices and which cause the light rays related to the neck portion to be undesirably reflected out of the clear sections of the neck section, and thus out of the desired beam pattern.

The present invention optically adapts the neck section 24 so as to improve the overall efficiency of the lamp. The overall effect of the reflector lamp 10 is to distribute more advantageously the total candlepower distribution and zonal lumens emitted by the finite light source 14 into the directed and desired beam pattern.

Figure 2:
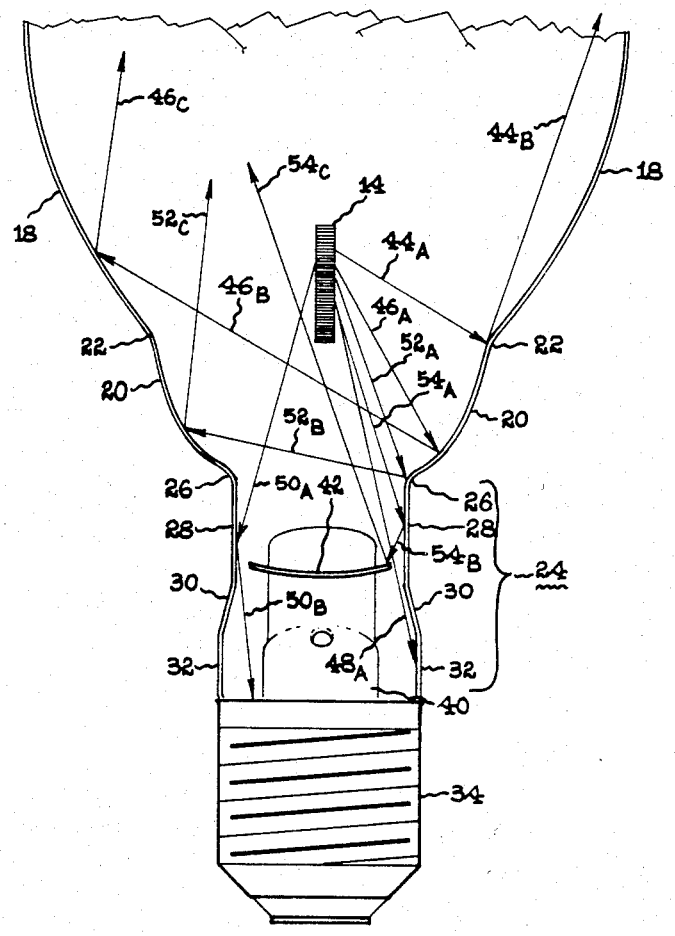
FIG. 2 is a partially segmented view illustrating improved light rays reflected internal to the lamp of FIG. 1.

The operation of the improved R lamp 10 of the present invention may be described with reference to FIG. 2. FIG. 2 mainly illustrates the improved light ray reflections distribution of the neck section 24 comprised of sections 26, 28, 30 and 32.

FIG. 2 is a partially segmented view of the lamp 10 so as to illustrate the improved direction of the light rays $44_{A'}$ $46_A$ . . . $54_C$ emitted by the light source 14 into the desired beam pattern. Although only light rays $44_{A'}$ $46_A$ . . . $54_C$ are illustrated in FIG. 2 as representative of the related light rays emitted from the central region of the finite light source 14, it is to be understood that the practice of this invention also applies to light rays emitted from all portions of the finite light source 14.

Light ray $44_A$ emitted by the finite light source 14 and striking section 22 so as to be advantageously reflected off sections 22 as light ray $44_B$ into the desired beam pattern is similar to light ray related to the R lamp described in the previously mentioned U.S. patent application Ser. No. 589,903. Similarly, light ray $46_A$ emitted by light source 14, striking intermediate reflective section 20 which is then reflected as light ray $46_B$ onto the primary reflective section 18 where it is reflected into the desired beam pattern as light ray $46_C$ is accomplished in a manner as described in U.S. patent application Ser. No. 589,903.

The present invention is primarily related to the interrelationships between the light rays associated with the neck section 24 and light reflective heat shield 42. The light reflective heat shield proximity to the optically contoured neck section 24 both cooperate to more advantageously reflect their associated light into the desired beam pattern relative to prior reflector lamps.

The advantages of the present reflector (R) lamp 10 may be described by first referring to the light rays $48_A$ . . . $50_B$ which end up outside of the desired beam pattern even for the present invention. Light ray $48_A$ emitted by light source 14 travel directly, without intercepting the light reflective shield 42, onto and out of the clear section 32 and thus is wasted light. Similarly, light ray $50_A$ emitted by light source 14 is reflected by reflective section 28 as light ray $50_B$ down into and eventual absorption by the electrically conductive base 34. The present invention reduces the available area for these type light rays $48_A$ and $50_B$ which is described with reference to light rays $52_A$ . . . $54_C$.

Light ray $52_A$ emitted by light source 14 strikes the reducing section 26 where it is reflected as light ray $52_B$ which in turn strikes and is reflected by the intermediate section 20 as light ray $52_C$ into the desired beam pattern. Similarly, light ray $54_A$ emitted by light source 14 strikes the cylindrical section 28 where it is reflected as light ray $54_B$ which in turn strikes and is reflected by reflective heat shield as light ray $54_C$ into the desired beam pattern.

The neck section, more particularly section 28 of neck section 24, along with the reflective heat shield 42 reduce the otherwise lost light rays emitted by light source 14. The section 28, along with the other sections 26, 30 and 32 of the neck section 24, have typical dimensions in the ranges given in Table 1:

TABLE 1

| Neck Section 24 | |
|---|---|
| Reducing Section 26 | Radius of curvature in the range of about 1.4 mm to about 4.0 mm |
| First Substantially Straight Cylindrical Section 28 | Inner diameter in the range of about 27 mm to about 31 mm and a length of about 6.35 mm to about 25.4 mm. |
| Second Substantially Straight Cylindrical Section 32 | Inner diameter in the range of about 35.6 mm to about 38.0 mm and a length in the range of about 25.6 mm to about 31 mm. |
| Expanding Section 30 | Minimum inner diameter in the range specified for section 28 and a maximum inner diameter in the range specified for section 32. |

The light reflective heat shield 42 has a radius of curvature in the range of about 50.8 mm to about 63.7 mm and is separated from the walls of section 28 by a distance in the range of about 1.57 mm to about 4.75 mm. Further, the light reflective heat shield is positioned onto the glass stem 40 so that it is located by a distance relative to the junction between sections 28 and 30, in the range of about 1.57 mm to about 12.7 mm.

The practice of this invention in accordance with the foregoing description of the reflector lamp 10 provides an efficiency improvement of about 10 percent over the standard reflector (R) lamps.

Although reflector lamp 10 has been described as having one intermediate reflective section 20, the practice of this invention contemplates one or more intermediate reflection sections, each having a parabolic shape substantially confocal with the primary reflective section 18 and each respectively joined by one or more transitional sections 22.

It should now be appreciated that the practice of the present invention provides for an improved reflector lamp having increased useful light output.

What we claim as new and desire to secure by Letters Patent of the United States is:

1. A reflector lamp comprising an electrically conductive base, a concave reflector, and a finite light source having its geometric center located approximately at the focal point of the concave reflector and rigidly affixed to an electrically insulative stem;

said concave reflector comprising:

(a) a primary reflective section having a parabolic shape and a focal point;

(b) one or more intermediate reflective section each having a parabolic shape substantially confocal with said primary reflective section and each respectively joined by one or more transitional sections and;

(c) a neck section effective in advantageously reflecting light rays impinging onto its surface back into the useful beam pattern of the reflector lamp and comprising;

($c_i$) a reducing section;

($c_{ii}$) a first substantially straight cylindrical section;

($c_{iii}$) an expanding section, and;

($c_{iiii}$) a second substantially straight cylindrical section for mating with the electrically conductive base.

2. A reflector lamp according to claim 1 further comprising:

a light reflective heat shield having a reflective surface that is positioned under such light source and mounted onto said electrically insulative stem.

3. A reflective lamp according to claim 2 wherein said light reflective heat shield is of a parabolic shape.

4. A reflective lamp according to claim 2 wherein said light reflective heat shield is separated from the inner walls of said first substantially straight cylindrical section by a distance in the range of about 1.5 mm to about 4.7 mm.

5. A reflector lamp according to claim 2 wherein said light reflective heat shield is separated from the junction of said first substantially straight cylindrical section and said expanding section by a distance in the range of about 1.57 mm to about 12.7 mm.

6. A reflector lamp according to claim 1 wherein one or more of said transitional sections have a radius of curvature in the range of about 1.0 mm to about 3.0 mm.

7. A reflector lamp according to claim 1 wherein said neck section comprises:

said reducing section has a radius of a curvature in the range of about 1.4 mm to about 4.0 mm;

said first substantially straight cylindrical section has an inner diameter in the range of about 27 mm to about 31 mm and a length of about 6.35 mm to about 25.4 mm;

said second substantially straight cylindrical section has an inner diameter in the range of about 35.6 mm to about 38.0 mm and a length in the range of about 25.6 mm to about 31 mm, and;

said expanding section has a minimum inner diameter in the range of said first substantially straight cylindrical section and a maximum inner diameter in the range of said second substantially straight cylindrical section.

8. A reflector lamp according to claim 1 wherein;

said expanding and said second substantially straight cylindrical sections are translucent, and;

said primary section, said one or more intermediate sections, said one or more transitional sections, and reducing section, and said first cylindrical section are coated with a reflective material.

9. A reflector lamp according to claim 1 wherein said light source is axially aligned parallel to the lamp axis.

10. A reflector lamp according to claim 1 wherein said light source is aligned perpendicular to the lamp axis.

11. A reflector lamp according to claim 1 wherein said light source comprises a tungsten filament.

12. A reflector lamp according to claim 1 wherein said light source comprises a halogen regenerative cycle lamp.

13. A reflector lamp according to claim 1 wherein said light source comprises an arc discharge lamp.

* * * * *